United States Patent [19]

Williams

[11] 4,139,772

[45] Feb. 13, 1979

[54] PLASMA DISCHARGE ION SOURCE

[75] Inventor: Norman Williams, New Hope, Pa.

[73] Assignee: Western Electric Co., Inc., New York, N.Y.

[21] Appl. No.: 822,866

[22] Filed: Aug. 8, 1977

[51] Int. Cl.[2] ..... H01J 27/00

[52] U.S. Cl. ..... 250/423 R; 250/427

[58] Field of Search ..... 176/6, 8; 250/427, 423

[56] References Cited

U.S. PATENT DOCUMENTS

| | | | |
|---|---|---|---|
| 2,373,151 | 4/1945 | Taylor | 250/427 |
| 2,427,484 | 9/1947 | West | 250/427 |
| 2,826,708 | 3/1958 | Foster | 250/423 |
| 2,829,259 | 4/1958 | Foner et al. | 250/427 |
| 2,831,996 | 4/1958 | Martina | 250/427 |
| 3,500,077 | 3/1970 | Post | 176/3 |
| 3,900,585 | 8/1975 | Matsubara | 427/13 |
| 3,999,072 | 12/1976 | Takagi | 250/427 |

OTHER PUBLICATIONS

"Physical Electronics" by Hemenway et al., pp. 215–219, published by John Wiley, 1967.

*Primary Examiner*—Harold A. Dixon

*Attorney, Agent, or Firm*—M. Pfeffer; A. S. Rosen; M. Y. Epstein

[57] ABSTRACT

An ion source is described in which a compound of the material of a desired ion is dissociated in a plasma discharge process to provide a beam of charged particles including the desired ions. The proportion of the desired ion in the particle beam is selected by adjustment of the temperature of the plasma, and, for increasing the range of selection of obtainable proportions, various means are described for increasing the plasma temperature beyond that which was previously attainable in ion sources of this type.

11 Claims, 6 Drawing Figures

FIG. 1
-PRIOR ART-
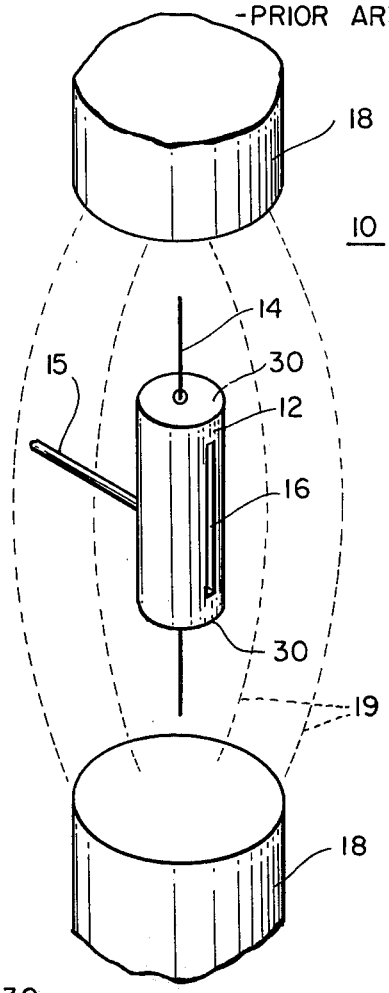
FIG. 5
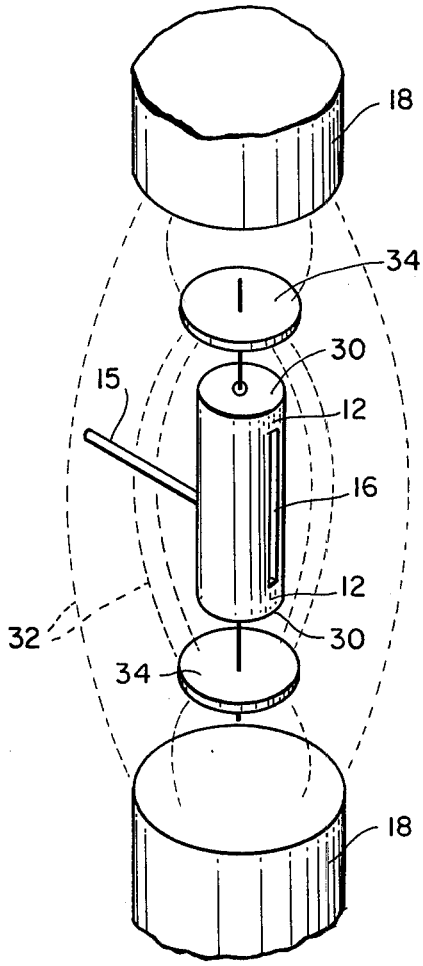
FIG. 4
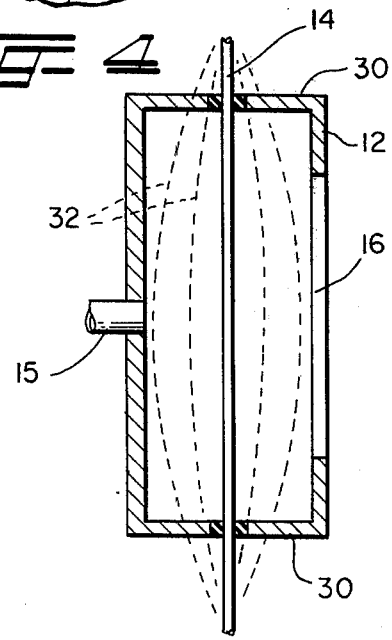
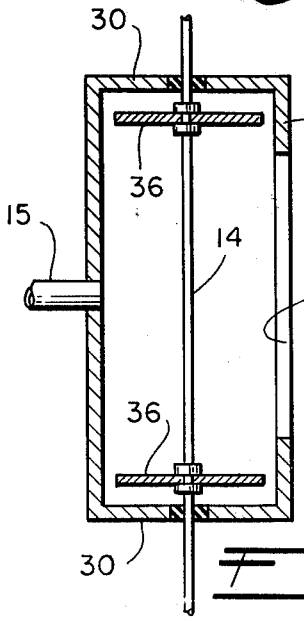
FIG. 6

PLASMA DISCHARGE ION SOURCE

BACKGROUND OF THE INVENTION

This invention relates to ion sources, and particularly to the type of ion source in which a compound of the material of a desired ion is dissociated in a plasma discharge process to provide a beam of charged particles. The beam includes the desired ions, which are generally subsequently separated from the beam by mass-charge separation techniques. While not so limited, the invention has particular utility in the production of singly charged boron ions for use in ion implantation apparatus.

One problem with prior art plasma dissociation ion sources is that it has not been known how to control fully the dissociation process, whereby the proportion of the desired ion in the output current is generally significantly less than what, at least, would appear to be possible. For example, if singly charged boron ions are desired from a source gas of a compound of boron, the total quantity of boron in the desired ionic form has, heretofore, been significantly less than the total quantity of boron present in the gas. That is, because it has not been known how to control fully the extent and completeness of the dissociation process, most of the boron present in the gas remains tied-up in non-useful molecular and electrically neutral forms.

Thus, for the purpose of increasing the usefulness and efficiency of such ion sources, a need exists for controlling the dissociation process for selecting and optimizing the proportions of selected ions in the ion source output current.

SUMMARY OF THE INVENTION

In accordance with this invention, it has been discovered that the proportion of the various ions in the ionic output current is a function of the ion source plasma temperature, and that a desired proportion of a selected ion of the output current can be obtained by adjustment of the plasma temperature. For the purpose of increasing the range of selection of the proportions of the various ions, various means are provided for increasing the plasma temperature beyond that which was previously attainable in plasma dissociation ion sources.

BRIEF DESCRIPTION OF THE DRAWINGS

FIG. 1 is a schematic illustration of a prior art ion source;

FIG. 2 being for a source gas of boron trifluoride, and FIG. 3 being for a source gas of boron trichloride;

FIG. 4 is a cross-sectional view of the anode of the ion source shown in FIG. 1 and illustrating a magnetic field configuration used in accordance with one embodiment of the invention;

FIG. 5 is a view similar to that of FIG. 1 but showing a modification of the prior art ion source for providing the magnetic field configuration illustrated in FIG. 4; and FIG. 6 is a view similar to that of FIG. 4 but showing a modification of the interior of the anode in accordance with a different embodiment of this invention.

DETAILED DESCRIPTION

Figure 3:
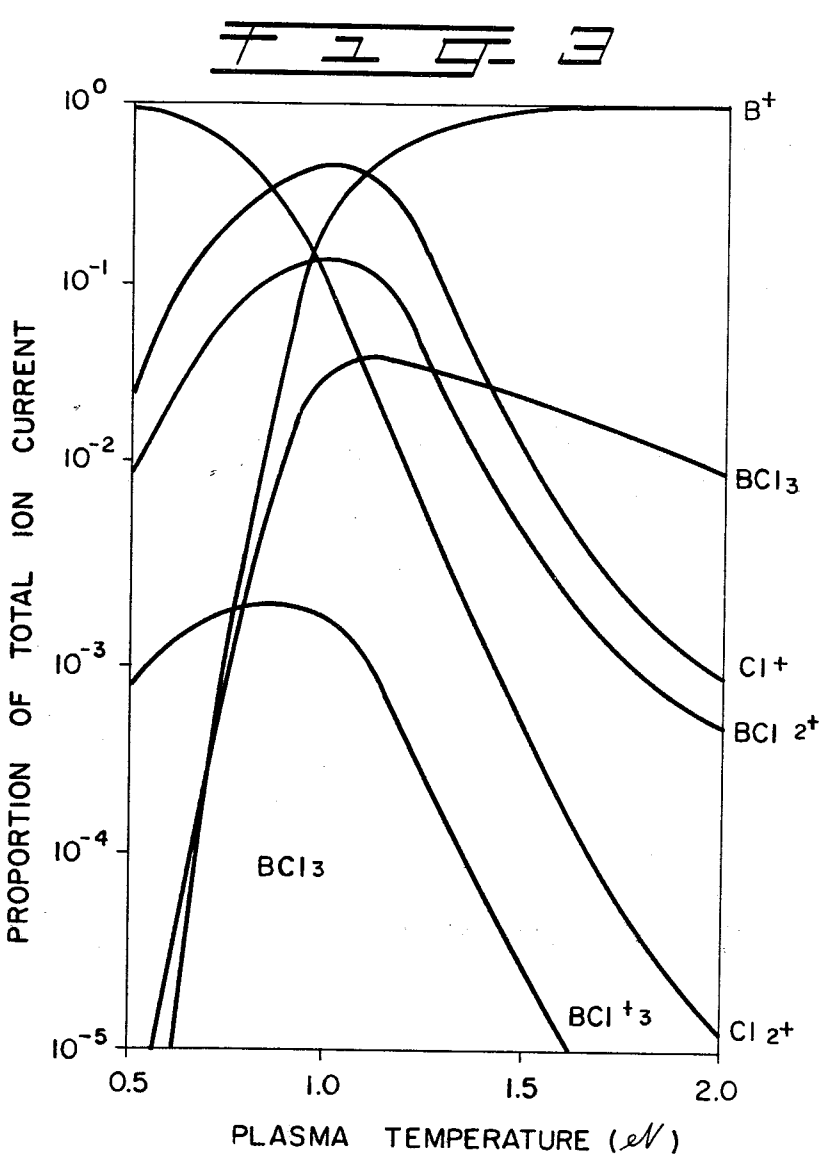
FIGS. 2 and 3 are graphs showing the proportion of the various ions in the output current from an ion source of the type shown in FIG. 1 plotted against plasma temperature.

Ion sources which rely upon the plasma dissociation of a gaseous source material are well known. With reference to FIG. 1, an example of a known source 10 is shown as comprising a generally closed cylindrical anode 12 of, for example, graphite or tantalum, having disposed therein (see, also, FIG. 4) an axially extending electrical resistance heated filamentary cathode 14. The source 10 is contained in an evacuated chamber (not shown), and a gaseous compound of the desired ionic material is flowed through the anode between an input tubing 15 and an exit slit-like opening 16. A direct current voltage differential is established between the anode and the cathode, the voltage being of sufficient amplitude to cause an electric discharge through the gas between the cathode and the anode. The electric discharge causes a dissociation of the gas into various neutral and charged particles. The neutral particles exit as part of the gas flow through the slit 16, and the charged particles, both positive and negative, fill the space within the anode 12. Positively charged particles which drift close to the slit 16 are extracted from the anode 12 and are accelerated by an electric field external to the source 10 to provide the beam of charged particles. The desired particles are separated from this beam using known mass-charge separation techniques.

For increasing the number of charged particles, that is, the density of the plasma within the anode 12, a magnet 18 is used to provide an axial magnetic field (represented by the dashed lines 19) about and within the anode 12. Such axial field tends to increase the path length of the plasma electrons, and thus the plasma density, by inducing the electrons to circle about the cathode rather than proceeding relatively directly from the cathode towards the anode. Also, because of the flow of current along the cathode 14, an additional magnetic field is present which causes the electrons to drift axially along the length of the anode towards the anode axial ends 30 where the electrons are collected. The importance of this electron axial drift is discussed hereinafter.

As previously noted, a shortcoming of such ion sources as used in the past is that the proportion of the desired ions in the ion beam is not significntly controllable, with the general result that only a relatively small quantity of the desired ions is available.

For example, a common source material for the production of singly charged boron ions ("$B^+$) is boron trifluoride ($BF_3$), a gaseous material at room temperature. (Elemental boron is not used as a source material owing to its high vaporization temperature.) Mass spectrographic analysis of the ionic beam produced using this source material reveals the presence of the desired boron ions, but also such ions as $BF^+$ and $BF_2+$, with the proportion of the desired singly charged boron ions to the total beam current (depending upon the particular ion source used) being generally less than 15 percent. That is, although the ion current contains much boron, much of it is tied up with fluorine atoms in non-useful forms.

In accordance with this invention, it has been discovered that the proportion of the various ions in the ion beam is a function of the temperature of the ion source plasma, and that the proportion of a selected ion of the beam current can be optimized to an extent not heretofore possible by control and selection of the plasma temperature. This is explained as follows.

In the plasma dissociation process, various collisions occur among the gas molecules and fragments thereof, and between the plasma electrons and the gas particles. While both types of collisions cause fragmentation of the gas molecules, it is believed that only electron collisions cause ionization of the particles.

The output beam from the ion source contains all the different positive ions produced in the dissociation process. I have demonstrated, however, that the proportion of these different ions in the beam depends upon the statistical probability or rate of occurrence of the different types of possible collisions, that is, upon the probability that certain fragments will be produced in the dissociation process, and upon the probability that these fragments will collide with electrons of sufficient energy to cause ionization thereof. Such probabilities, in turn, are a function of the dissociation and ionization energies of the impacted particles and a function of the energy of the impacting electrons. Thus, for a given source material, the probability of the occurrence of various collisions, and thus the degree of dissociation and ionization of the source gas, is a function of the energy distribution of the plasma electrons, that is, of the plasma temperature ($kT$, where K = Boltzmann's constant and T = temperature in degrees kelvin).

Figure 2:
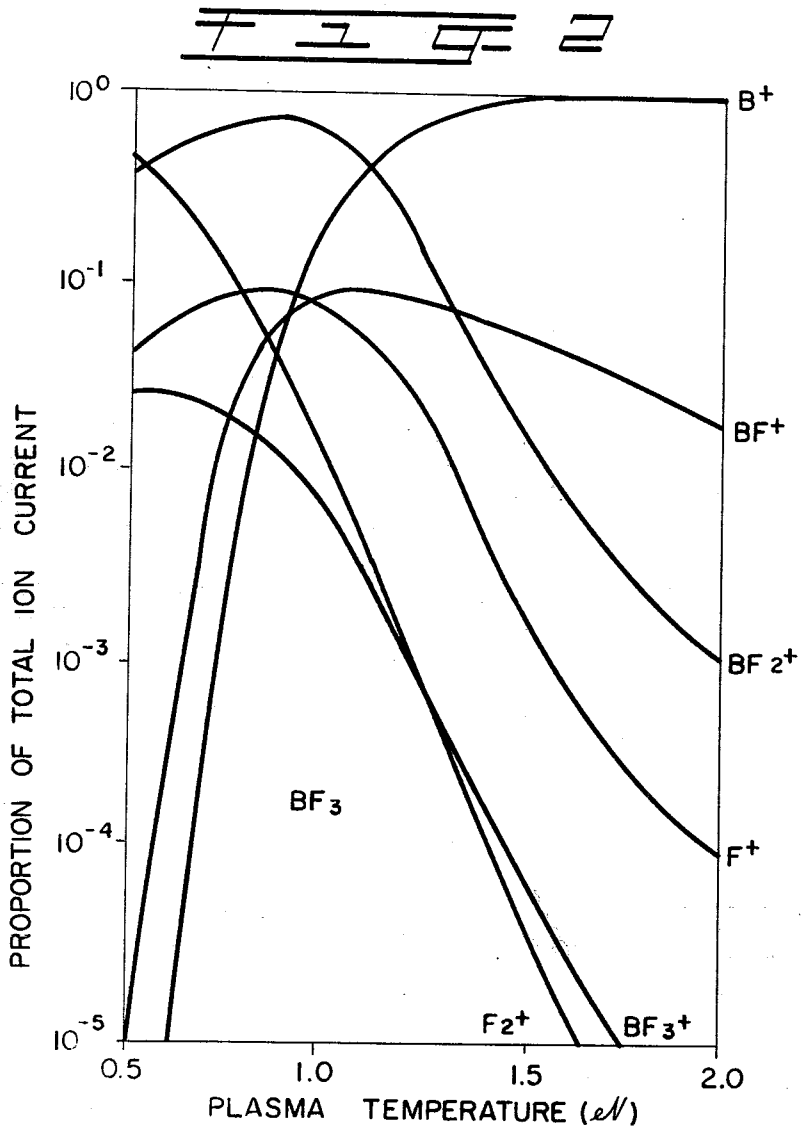

This is illustrated in FIGS. 2 and 3 which show the proportional composition of the ion beam from an ion source of the type shown in FIG. 1 plotted against the plasma temperature in electron volts. FIG. 2 is for a source material of boron trifluoride, and FIG. 3 is for boron trichloride. The data for these graphs were derived mathematically, and owing to certain assumptions made to simplify the calculations, it is expected that certain inaccuracies exist. Experimental data do exist, however, which support the general validity of the relationships shown. Thus, based upon these graphs, a desired proportion of any ion in the ion beam can be obtained, within the possible range of proportions of the ion, by adjusting the temperature of the plasma to the corresponding plasma temperature indicated on the graph. Thus, for example, from the graph of FIG. 3, it is determined that the maximum proportion of singly charged chlorine ions ($Cl^+$) in an ion beam produced from a source gas of boron trichloride is obtained at a plasma temperature of about 1.0 eV. Similarly, the curves representing the proportions of singly charged boron ions ($B^+$) begin peaking at a plasma temperature of about 1.5 eV for both source gases (FIGS. 2 and 3).

At relatively low plasma temperatures, such as below about 1.0 eV, the plasma temperature can be adjusted by varying the axial magnetic field strength and/or the anode to cathode discharge voltage. Because the plasma temperature is not strictly an independent variable, being a function of the plasma density and the particular source gas material used, a trial and error plasma temperature varying process can be used.

It is noted that adjustments of the axial magnetic field strength and discharge voltage amplitude have been made in the past for maximizing the quantity of the desired ion in the output current of the prior art ion sources of the type shown in FIG. 1. To my knowledge, however, it has not been heretofore recognized that these adjustments cause variations in the plasma temperature, or that any particular proportion of ions can be selected by proper adjustment of the plasma temperature. Also, I have determined that the maximum plasma temperature obtainable solely by virtue of adjustments of these parameters is relatively low, whereby the degree of control over the output current proportions has heretofore been quite limited. An important feature of this invention, therefore, is the development of techniques for increasing the maximum attainable plasma temperatures in plasma dissociation ion sources. One such means for increasing the plasma temperature is as follows.

As previously noted, the plasma electrons tend to drift axially along the length of the anode 12. Those electrons which reach the anode axial ends 30 are collected by the anode and are thus removed from the plasma. Because the electrons of highest energy and thus of highest velocity drift the fastest, the higher energy electrons are removed more quickly from the plasma than the lower energy electrons. The result of this is that a disproportionately large number of higher energy electrons is removed from the plasma by collection at the anode axial ends. This tends to reduce the energy distribution of the electrons of the plasma and thus reduce the plasma temperature. Accordingly, one means for increasing the plasma temperature is to reduce the collection of electrons at the anode axial ends.

In accordance with one embodiment of this invention, this is accomplished by modifying the shape of the magnetic field to improve the magnetic "bottle" characteristics of the field. This is illustrated in FIG. 4 which shows a magnetic field (indicated by the dashed lines 32) which is more concentrated or constricted at the axial ends 30 of the anode 12 than at the center thereof. The effect of such a magnetic field shape, as is generally known, is to turn back or "reflect" electrons which are drifting from the central, lower strength regions of the field towards the higher strength axial ends of the field. Thus, as used in the embodiment of the invention shown in FIG. 4, the end constricted magnetic field tends to reduce the drift of electrons towards the axial ends of the anode 12 and to thus reduce the collection of electrons thereat. As aforenoted, such reduction of electron collection causes an increase in the temperature of the plasma.

The greater the ratio of magnetic field strength at the axial ends of the anode to the strength at the center thereof, the more efficient is the magnetic field "bottle" with respect to increasing the plasma temperature. This ratio is known as the "mirror" ratio.

One means for providing the desired constricted magnetic field of the shape shown in FIG. 4 is by the use of two discs 34 (FIG. 5) of magnetic material, such as steel, disposed closely adjacent to each axial end 30 of the anode 12. The constricting effect of the discs 34 on the magnetic field produced by the magnet 18 is evident by comparison of the arrangement shown in FIG. 5 with the prior art arrangement shown in FIG. 1. The mirror ratio of the magnetic field in the arrangement shown in FIG. 5 is 1.35, whereas the mirror ratio of the prior art arrangement shown in FIG. 1 is 1.17.

The actual increase in plasma temperature caused by the increased mirror ratio is a function of the particular source material used, hence no generalized figures can be given. An example of such increase, however, is as follows.

In use of the prior art ion source 10 shown in FIG. 1, the maximum content of the singly charged boron ion in the output beam heretofore obtainable is about 15 percent with a source gas of boron trifluoride, and about 6 percent with a source gas of boron trichloride. These boron contents correspond to a plasma temperature of about 1.0 eV with the boron trifluoride source gas (FIG. 2), and about 0.85 eV (FIG. 3) with the boron trichloride source gas. In use of the ion source shown in FIGS. 4 and 5, however, the proportion of singly charged boron ions in the output beam is increased to about 25 percent for the boron trifluoride source gas and to about 10 percent for the boron trichloride source gas. These increases in the proportion of the boron ions in the two output currents correspond to an increase of plasma temperature of about 0.1 eV.

A means for further improving the mirror ratio of magnetic fields for increasing the plasma temperature in ion sources of the type herein described is the substitution of two disc-like permanent magnets (not illustrated) for the steel discs 34 shown in FIG. 5. By proper spacing of such permanent magnets (which would also replace the external magnet 18), a mirror ratio of about 15 is considered possible. An example of such proper spacing is provided hereinafter.

A difficulty with the disc permanent magnet arrangement, however, is that by disposing the permanent magnets close to the anode 12, in order to obtain the necessary magnetic field shaping, the magnets are subject to being heated by radiation from the anode which operates at a quite high temperature. Thus, unless special precautions are taken, such as water cooling of the permanent magnets, overheating of the magnets and destruction of the magnetic properties thereof can occur.

Another means believed effective for increasing the plasma temperature is, as shown in FIG. 6, the mounting of refractory metal shields 36, for example, of tantalum, directly on the filament 14 inside of and closely adjacent to the axial ends 30 of the anode 12.

In use, the shields 36, at filament potential, electrostatically shield the anode axial ends 30 from the plasma and thus reduce the collection of electrons by these portions of the anode. Accordingly, for the same reasons previously described in connection with the description of the embodiment of the invention shown in FIG. 4, the plasma temperature is increased.

Each of the aforedescribed embodiments of the invention is effective to increase the maximum attainable plasma temperature. Such maximum plasma temperatures are obtained at an optimum setting, determined by a trial and error process, of the magnetic field strength and the anode to cathode discharge voltage. Adjustment of the plasma temperature to less than the maximum possible temperature is possible by adjustments away from the optimum settings of the magnetic field strength and/or the discharge voltage. Thus, in accordance with this invention, there is made available in the use of ion sources of the type described an increased range of possible operating plasma temperatures, thereby increasing the range of attainable proportions of the various ions in the source output current.

As previously noted, in use of the ion source 10 shown in FIG. 1 according to the prior art, the maximum plasma temperature heretofore obtainable is about 1.0 eV with a source gas of boron trifluoride and about 0.85 eV with a source gas of boron trichloride. An examination of FIGS. 2 and 3, however, reveals that substantial increases in the proportion of singly charged boron ions in the output current are obtainable if higher plasma temperatures are used. Accordingly, one important use of this invention is the attainment of higher proportions of singly charged boron ions from ion sources of the type described by providing means for increasing the plasma temperature of the ion source beyond that which was previously possible. In particular, increases in the plasma temperature, and corresponding increases of the boron ion content of the output beam are obtained, according to one aspect of this invention, by the use of magnetic fields having a mirror ratio in excess of 1.2. Stated on a different basis, increases in the boron ion proportions are obtained by the use of plasma temperatures in excess of 1.0 eV with a source gas of boron trifluoride and in excess of 0.85 eV with a source gas of boron trichloride.

With reference again to the embodiment of the invention shown in FIG. 5, it is noted that, with the exception of the inclusion of the magnetic material discs 34, the ion source is identical to the prior art ion source 10 shown in FIG. 1. By way of specific example, in one embodiment of the inventive ion source shown in FIG. 5, the anode 12 has a length of about three inches (7.5 cm) and a diameter of about one inch (2.54 cm). The magnets 18 have a diameter of about four inches (10 cm), and are spaced about three inches (7.5 cm) from the axial ends 30 of the anode 12. The discs 34 have a thickness of about ¼ inch (0.62 cm), a diameter of about 1½ inch (3.75 cm), and are spaced about ¾ inch (1.8 cm) from the anode.

In the aforedescribed embodiment in which permanent magnet discs are substituted for the steel discs 34, the permanent magnets can be of identical dimensions and spacings from the anode 12 as aforedescribed for the discs 34.

What is claimed is:

1. A method of forming a beam of particles which includes a plurality of ions of a desired material, comprising the steps of establishing between an axially extending anode and an axially extending cathode an electric discharge of sufficient intensity to dissociate a gaseous compound, which includes the desired material, into a plasma comprising various particles including a plurality of ions of the desired material; applying a magnetic field to said plasma; and discharging particles from the vicinity of said anode and said cathode in the form of a beam of particles including ions of the desired material, wherein the improvement comprises:

so disposing a pair of magnetic members, one adjacent to each axial end of said anode, as to constrict said magnetic field at said axial ends of the anode to increase the temperature of the plasma to a temperature above a maximum temperature which may be achieved in the plasma in the absence of said magnetic members.

2. A method of forming a beam of particles which includes a plurality of ions of a desired material, comprising the steps of establishing between an axially extending anode and an axially extending cathode an electric discharge of sufficient intensity to dissociate a gaseous compound, which includes the desired material, into a plasma comprising various particles including a plurality of ions of the desired material; applying a magnetic field to said plasma; and discharging particles from the vicinity of said anode and said cathode in the form of a beam of particles including ions of the desired material, wherein the improvement comprises:

so disposing a pair of electrostatic shielding members, one adjacent to each axial end of said anode, as to electrostatically shield said axial ends of the anode from said plasma to increase the temperature of the plasma to a temperature above a maximum temperature which may be achieved in the plasma in the absence of said electrostatic shielding members.

3. Apparatus for forming a beam of particles which includes a plurality of ions of a desired material, comprising:

an axially extending anode;

an axially extending cathode;

means for introducing between the anode and the cathode a gaseous compound which includes said desired material;

means for establishing between the anode and the cathode an electric discharge of sufficient intensity to dissociate said gaseous compound into a plasma which comprises various particles including a plurality of ions of the desired material;

means for applying a magnetic field to said plasma;

a pair of magnetic members so disposed, one adjacent to each axial end of the anode, as to constrict the magnetic field, applied by said magnetic field applying means, at said axial ends of the anode, to increase the temperature of said plasma above a temperature which may be achieved in the plasma by operation of said electrical discharge establishing means and said magnetic field applying means in the absence of said magnetic members; and means for discharging particles from the vicinity of said anode and said cathode in the form of a beam of particles including ions of the desired material.

4. Apparatus for forming a beam of particles which includes a plurality of ions of a desired material, comprising:

an axially extending anode;

an axially extending cathode;

means for introducing between the anode and the cathode a gaseous compound which includes said desired material;

means for establishing between the anode and the cathode an electric discharge of sufficient intensity to dissociate said gaseous compound into a plasma which comprises various particles including a plurality of ions of the desired material;

means for applying a magnetic field to said plasma;

a pair of electrostatic shielding members so disposed, one adjacent to each axial end of said anode, as to electrostatically shield said axial ends of the anode from said plasma to increase the temperature of said plasma above a temperature which may be achieved in the plasma by operation of said electrical discharge establishing means and said magnetic field applying means in the absence of said electrostatic shielding members; and means for discharging particles from the vicinity of said anode and said cathode in the form of a beam of particles including ions of the desird material.

5. Apparatus as set forth in claim 4, wherein said temperature increasing means further comprise:

means for increasing the mirror ratio of the magnetic field, applied by said magnetic field applying means, to a value in excess of 1.2.

6. A method of plasma dissociating a gaseous compound, which includes the material of a desired ion, in such manner as to form a beam of particles which includes a controlled proportion of the desired ion, comprising the steps of establishing between an anode and a cathode an electric discharge through said gaseous compound of sufficient intensity to dissociate the gaseous compound into a plasma comprising various particles including a plurality of the desired ions; applying a variable magnetic field to said plasma; adjusting said magnetic field to such intensity that the proportion of the desired ion in the plasma attains a maximal value; and discharging particles from the vicinity of said anode and said cathode in the form of a beam of particles including a plurality of the desired ions, wherein the improvement comprises:

while maintaining the magnetic field at said intensity, increasing the temperature of the plasma such that the proportion of the desired ion in said plasma is increased to a control value greater than said maximal value.

7. A method as set forth in claim 6, wherein said electric discharge is established between an axially extending anode and an axially extending cathode, said temperature increasing step comprising:

so disposing a pair of magnetic members, one adjacent to each axial end of said anode, as to constrict said magnetic field at said axial ends of the anode.

8. A method as set forth in claim 6, wherein said electric discharge is established between an axially extending anode and an axially extending cathode, said temperature increasing step comprising:

so disposing a pair of electrostatic shielding members, one adjacent to each axial end of said anode, as to electrostatically shield said axial ends of the anode from said plasma.

9. A method as set forth in claim 6, wherein said temperature increasing step comprises:

increasing the mirror ratio of said magnetic field to a value in excess of 1.2.

10. A method as set forth in claim 7 for forming a beam of particles including singly charged boron ions by plasma dissociating a boron trichloride gas at a temperature in excess of 0.85 eV.

11. A method as set forth in claim 7 for forming a beam of particles including singly charged boron ions by plasma dissociating a boron trifluoride gas at a temperature in excess of 1.0 eV.

* * * * *